US005987790A

United States Patent [19]

Sullivan

[11] Patent Number: 5,987,790

[45] Date of Patent: Nov. 23, 1999

[54] STITCHABLE DOMED DISPLAY

[75] Inventor: Michael J. Sullivan, Barrington Hills, Ill.

[73] Assignee: Michael J. Sullivan, Inc., Arlington Heights, Ill.

[21] Appl. No.: 08/917,656

[22] Filed: Aug. 25, 1997

[51] Int. Cl.[6] ..... A44C 3/00

[52] U.S. Cl. ..... 40/1.5; 40/675; 40/800; 428/13

[58] Field of Search ..... 40/329, 299.01, 40/626, 636, 661.04, 661.11, 662, 675, 800, 615; 428/13

[56] References Cited

U.S. PATENT DOCUMENTS

| | | | |
|---|---|---|---|
| 4,307,527 | 12/1981 | Suzuki | 40/661 |
| 4,332,074 | 6/1982 | Auld et al. | 29/527.4 |
| 4,386,123 | 5/1983 | Coburn, Jr. | 428/13 X |
| 4,481,160 | 11/1984 | Bree | 428/13 X |
| 4,556,588 | 12/1985 | Rockwood | 428/13 |
| 4,682,433 | 7/1987 | Stilling | 40/675 X |
| 5,572,741 | 11/1996 | Bowman | 40/626 X |

*Primary Examiner*—Brian K. Green
*Attorney, Agent, or Firm*—Gilhooly and Crossman

[57] ABSTRACT

A domed stitchable display article having a substrate base formed from a laminated plastic and fabric. Printing images are applied to the upper surface and are encapsulated by a dome formed from a polyurethane rubber. A barrier is applied to the upper surface to alter the surface tension of the upper surface and limit outward flow of polyurethane during the fabrication portion. The substrate base forms stitchable flange portions.

2 Claims, 1 Drawing Sheet

STITCHABLE DOMED DISPLAY

BACKGROUND OF THE INVENTION

1. Field of the Invention

The present invention relates in general to display articles and more particularly, to a stitchable display having a domed portion affixed to a substrate.

2. Description of the Prior Art

Display articles in the form of labels, tags, emblems, and the like have long been applied to clothing, hats, shoes, and in countless other applications for uses as identification, product marking, aesthetic appearance among other purposes. In the past, urethane coatings have been applied to labels, badges and the like as a coating for encapsulating printed emblems on materials such as polyester or vinyl. None of the previous techniques have satisfactorily combined the attractiveness and suitability of a domed portion to highlight printed artwork encapsulated therein along with the capability of being readily securable to an article.

It is particularly desirable to use decorative nameplates or emblems as a way of creating a positive consumer conception of an article from an aesthetic standpoint and an informational one. A three-dimensional appearance can further emphasize the effectiveness of a nameplate. Such three dimensional displays currently in use suffer from several deficiencies, including cost of manufacture, their overall appearance and ease of attachment to an article. Other plastic coated nameplates and the like have resulted in attractive articles, but have suffered from certain shortcomings, including the inability to be easily fastened due to thinness of structure. In general, prior designs for nameplates and the like have not combined the advantages of product enhancement with long-lasting use and ease of attachment to articles.

Therefore, it is desirable to provide an improved display article in the form of a domed tag, badge, emblem and the like that is capable of long use and ease of attachment to an article, particularly through stitching.

SUMMARY OF THE INVENTION

It is, therefore, an objective of this invention to provide an improved decorative or informational domed display that is capable of an extended lifetime of use while being readily attachable to an article by stitching or other techniques. The display of the invention is in the form of a nameplate, badge and emblem having a domed portion which enhances the visual presentation of the image printed on a substrate. The domed structure encapsulates the printed image by a polyurethane and the like to provide not only an attractive display, but long life due to the sealed environment beneath the dome. The dome of the invention is applied to the substrate by a novel process by which the surface tension of the substrate is altered to form a permanent barrier to result in the flowable urethane ceasing to flow during the fabrication process. Thus, the change in surface tension creates a permanent surface tension delineator, which, in essence, impedes or restricts the flow of the urethane beyond the area on which the dome is being applied. As a result of the unique design, a border area that is stitchable is created to allow its attachment by mechanical stitching to a fabric or other article to which the user desires to apply the nameplate.

DESCRIPTION OF THE PREFERRED EMBODIMENT

Figure 1:
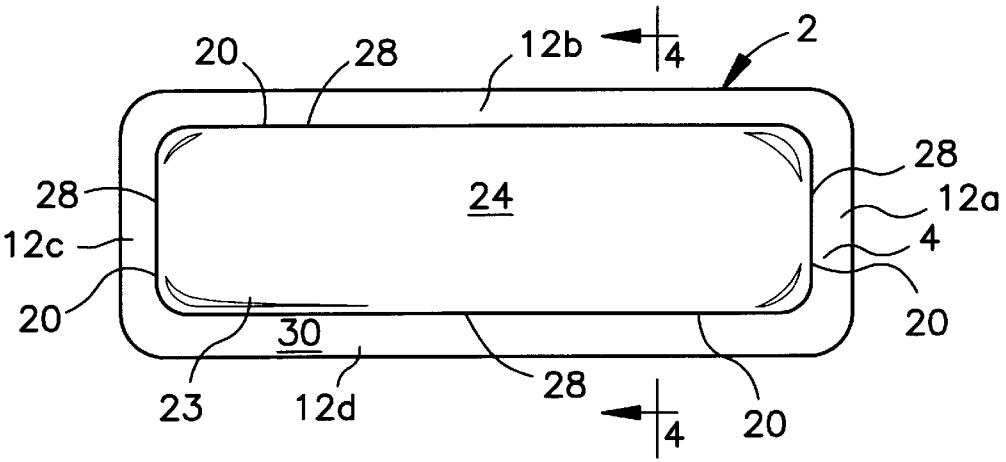
FIG. 1 is a top plan view of the domed display of the invention.
Figure 2:
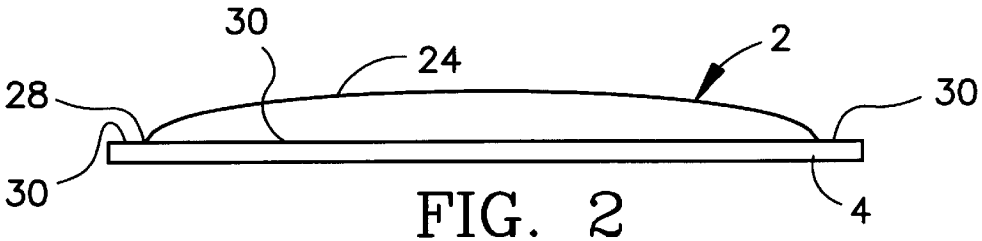
FIG. 2 is a front elevational view of the domed display of FIG. 1.
Figure 4:
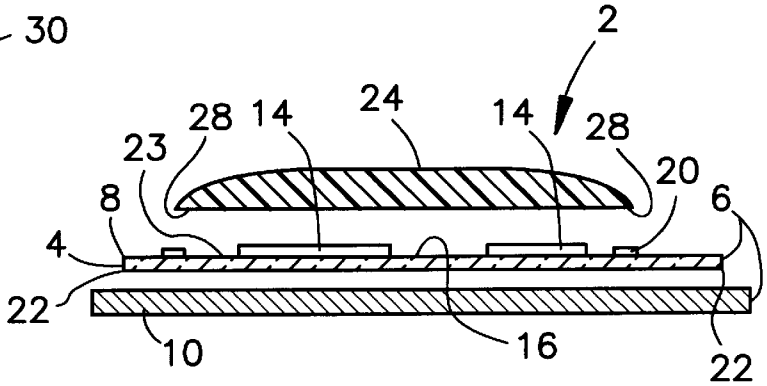
FIG. 4 is an end elevational view, with parts exploded, of the domed display of FIG. 1.
Figure 3:
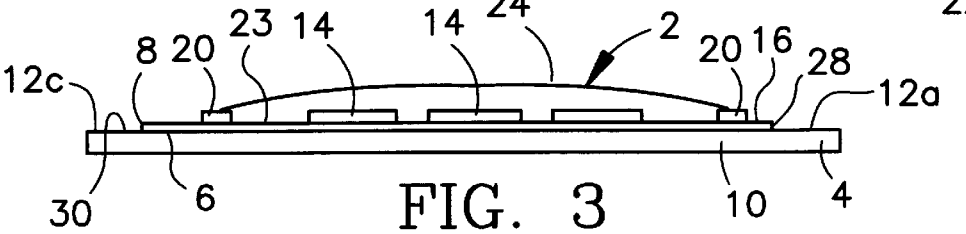
FIG. 3 is an end elevational view of the domed display of FIG. 1.

Referring now to FIGS. 1–4, there is illustrated the improved stitchable domed display of the invention, generally designated by reference numeral 2. The stitachable domed display 2 may be used in many applications in which attractive or informational displays are desirable, such as, for example, as nameplates, badges, decals, labels, and other common uses for such display articles. The domed display 2 may be affixed to clothing, shoes, hats, coats and any other items that otherwise be embroidered or would utilize rubber as a decorative item. The stitchable domed display 2 includes a base 4 which is shown in FIGS. 1–4 as being formed from a generally rectangular substrate 6. It is within the scope of the invention for the shape of base 4 in plan view to possess other configurations as desired. The substrate 6 includes an upper printable plastic layer 8 formed from a Mylar sheet or other plastic material. The upper layer 8 is laminated by a conventional process to the bottom layer of a sheet of fabric 10 forming a stitchable backing. As seen in FIGS. 1–4, the fabric 10 or other stitchable material is larger than upper layer 8 and extends beyond the layer 8 to form an exposed border portions 12*a–d*. A printed image 14, such as created by ink or other well known techniques, is applied to the upper surface 16 of substrate layer 8 to display an exposed image of any design or script. A barrier 20 is applied along a border 5 area of upper surface 16 generally continuously along paths spaced from the edges 22 of upper layer 8. The barrier 20 may be in the form of a material sold under the trademark Flow Stop, manufactured by Development Associates in North Kingston, Rhode Island, to provide a change in surface tension of upper surface 16 of upper layer 8 and create a surface tension delineation. The barrier 20 defines an image receiving area 23 upon which printing area 14 is present.

A dome 24 is applied to upper surface 16 and encapsulates the printing area 14 in spaced relation to upper surface 16 except at contacting perimeter portions 28. The dome may form from a flowable rubber material in its fabrication stage, such as a poured polyurethane, or a plastic material of similar properties. In the novel fabrication process of the invention, polyurethane material is poured and the flowable material flows outward on upper surface 16. As it approaches the perimeter created by barrier 20, the flowable material of the dome 24 ceases to flow and hardens in the attachment to the substrate 6. The perimeter barrier 20 then defines the perimeter of encapsulated area 23 covered by the dome 24. The substrate 4 forms outwardly extending flanges 30 beyond the encapsulated area 22. The encapsulated display 2 then may be applied mechanically attached to any item of clothing and the like by conventional stitching or other mechanical fastening techniques. Alternately, the novel process of the invention for doming on a substrate may also be used in situations in which the display, such as a decorative nameplate or decal, is selectively domed to highlight the printed portion of the substrate without coating the whole part.

What is claimed is:

1. A display article comprising a base having printed images on an upper surface, a dome for encapsulating said printing images, said dome being connected to said base along a perimeter defining a predetermined area, said perimeter being defined by a barrier being applied on said upper surface and containing said dome, said base having border portions extending beyond said perimeter and forming portions to permit mechanical fastening of said base to an item, and said base is formed as a substrate having an upper plastic layer forming said upper surface and a lower fabric layer.

2. The display article according to claim 1 wherein said substrate has a flat configuration with said border portions extending beyond said plastic layer to permit stitching.

* * * * *